US005411353A

United States Patent [19]

Taki

[11] Patent Number: 5,411,353

[45] Date of Patent: May 2, 1995

[54] SOIL SOLIDIFICATION APPARATUS WITH A SHEAR BLADE OF ADJUSTABLE LENGTH AND ROTATION SPEED FOR CREATING A RIBBED SOIL-CEMENT PILE

[76] Inventor: Osamu Taki, P.O. Box 1297, Belmont, Calif. 94002

[21] Appl. No.: 115,228

[22] Filed: Sep. 1, 1993

[51] Int. Cl.[6] ..... E02D 3/12

[52] U.S. Cl. ..... 405/241; 405/233; 405/269

[58] Field of Search ..... 405/233, 240, 241, 248, 405/252.1, 253, 269, 266; 175/394

[56] References Cited

U.S. PATENT DOCUMENTS

| | | | |
|---|---|---|---|
| 2,783,974 | 3/1957 | Veasman | 175/394 X |
| 4,902,172 | 2/1990 | Fukuda | 405/269 |
| 5,006,016 | 4/1991 | Fukuda | 405/240 |
| 5,295,769 | 3/1994 | Sano | 405/266 |

FOREIGN PATENT DOCUMENTS

| | | | |
|---|---|---|---|
| 36592 | 3/1980 | Japan | 405/241 |
| 521 | 1/1983 | Japan | 405/248 |
| 154214 | 9/1984 | Japan | 405/240 |
| 125017 | 5/1990 | Japan | 405/241 |
| 213514 | 8/1990 | Japan | 405/241 |
| 212506 | 9/1991 | Japan | 405/241 |
| 247923 | 9/1993 | Japan | 405/241 |

*Primary Examiner*—Randolph A. Reese
*Assistant Examiner*—John A. Ricci
*Attorney, Agent, or Firm*—Greg T. Sueoka

[57] ABSTRACT

A soil mixing apparatus that requires less drilling force comprises a shaft, a plurality of cutting blades, an excavation blade, an auger bit, a shear blade having an extendible finger. The cutting blades, excavation blade and auger bit are attached to rotate with the shaft. The shear blade is attached at a fixed longitudinal position along the shaft. The shear blade provides a variable length by attaching different length fingers that are adjustable to the soil conditions in which the mixing apparatus is used. The shear blade is also mounted to the shaft at an angle such that the shear blade rotates in the same direction as the excavation blade and the cutting blades, but at a much slower rotation rate.

21 Claims, 6 Drawing Sheets

SOIL SOLIDIFICATION APPARATUS WITH A SHEAR BLADE OF ADJUSTABLE LENGTH AND ROTATION SPEED FOR CREATING A RIBBED SOIL-CEMENT PILE

BACKGROUND OF THE INVENTION

1. Field of the Invention

The present invention relates to an apparatus for drilling and in situ mixing to construct soil-cement piles for soil solidification purposes. In particular, the present invention relates to a shear blade for a mixing apparatus that requires less vertical force for drilling and withdrawing the apparatus. The apparatus of the present invention also relates to devices for producing ribbed soil-cement piles.

2. Description of Related Art

There are a variety of methods used in the prior art to increase the ability of the ground to support buildings and other structures. One such conventional method for increasing the support provided by the ground is the construction of piles or columns of soil and cement. These piles can be created by excavating soil, inserting a cylindrical casing, and then filling the casing with a combination of excavated soil and cement. Other methods in the prior art create such piles by in situ mixing of the soil and cement. One type of pile used for soil solidification purposes is an end bearing pile. End bearing piles have a generally cylindrical shape and a length that extends from the surface of the ground downward to bedrock, or to a point where the soil is hard and will not settle significantly. However, end bearing piles are typically quite long and thus expensive to construct. Therefore, their use has been limited to larger multiple level buildings where the ground must be firm and settling is unacceptable.

Friction piles have also been used in the prior art in an attempt to provide a more cost effective means of soil solidification. Friction piles similarly have a generally cylindrical shape, but have a limited length. The load bearing capacity of such friction piles is determined primarily by the friction between the soil and the exterior surface of the pile. One key aspect of friction piles is to provide good surface friction. Friction piles are constructed in soft soil and will allow some settling because they do not rest on bedrock or hardened soil due to their limited length. Therefore, their primary use has been limited to smaller housing structures with one or two levels where downward movement of the pile due to settling of the ground is tolerable.

One problem in the prior art, especially for friction piles, is the bearing capacity provided. Especially in soft soil conditions, the pile will not provide the desired bearing capacity. Therefore, more piles must be constructed to increase the density of piles per square foot, and thus, increase the overall bearing capacity per square foot. However, each additional pile that must be constructed requires significant time and effort. Therefore, there is a need for a system and method that can be used to increase the bearing capacity or the frictional resistance to vertical movement of each pile, and thereby eliminate the need to add more piles to increase the overall bearing capacity.

The prior art provides a variety of conventional drilling devices for drilling into the ground and mixing the soil with grout or additives for soil improvement purposes. A major drawbacks of such existing drilling devices is that they can only be used in very soft soil conditions and for shallow drilling. Soil that is hard prevents the use of these existing drilling devices. For example, in situations where the soil has regions that are very compact and dense, existing drilling devices cannot be used. Such hard soil conditions require that the downward force applied to the drilling apparatus, in particular the shear blade, be increased significantly to overcome the huge resistance applied to the shear blade as the drilling apparatus penetrates downward into the soil. When the compact areas of soil are encountered, it is difficult, if not impossible, to move the drilling apparatus further downward because the ends of the shear blade cannot penetrate the compact areas of soil. While the blades and the other portions of the drilling apparatus can be strengthened to increase their ability to penetrate the soil, the cost and time of such reinforcement of the apparatus is not economically feasible.

Another problem with the prior art drilling systems and very compact soil is the difficulty in controlling the drilling direction. Additional resistance encountered by the drilling device in very compact soil requires that additional downward force be applied to the drilling device. This additional downward force pushes the ends of the shear blade through the hardened soil. However, this additional downward force often causes the shaft to flex or bend. The bending of the shaft in turn causes the auger bit to veer off its original linear path making it very difficult to drill a pile along a straight line in the vertical direction as desired. Moreover, the bending of the shaft increases the likelihood that the shaft will break. Thus, the shear blades of the prior art are particularly problematic for other than normal soil conditions.

Therefore, there is a need for a drilling apparatus that is adaptable to a variety of soil types and that reduces the amount of downward force applied to the apparatus. There is also a need for a drilling apparatus that provides improved control over the drilling direction. Finally, there is a need for an apparatus that can create soil-cement piles with increased surface friction.

SUMMARY OF THE INVENTION

The present invention overcomes the deficiencies of the prior art by providing an in situ mixing apparatus that requires less vertical drilling force for drilling and withdrawing the apparatus from the ground. The mixing apparatus also produces ribbed soil cement columns. The mixing apparatus of the present invention preferably comprises a shaft, an excavation blade, a plurality of cutting blades, an auger bit, and a shear blade. The excavation blade, the cutting blades and the auger bit are fixably attached to rotate with the shaft. In contrast, the shear blade is attached at a fixed longitudinal position along the shaft but not directly connected. The shear blade of the present invention advantageously provides a variable diameter that is adjustable to the soil conditions in which the drilling apparatus is used. The shear blade of the present invention is also mounted to the shaft at an angle $\alpha$ such that the shear blade rotates in the same direction as the auger bit, the excavation blade and the cutting blades; but at a slower rotation rate. In the preferred embodiment, the angle $\alpha$ at which the shear blade is mounted to the shaft is greater that the angle $\beta$ at which the cutting blades are mounted to the shaft (i.e., $\alpha > \beta$). The fingers and tips of the shear blade may also have a variety of configurations that are used to properly adjust and control the rotation rate of the shear blade. The variable shape of the tips greatly reduces the downward force that needs be applied to the drilling apparatus and controls the rotation rate of the shear blade. The length of the fingers can also be adjusted to change the size of the ribs. Other features and advantages of the present invention will become apparent from the following description taken in conjunction with the accompanying drawings.

DETAILED DESCRIPTION OF THE PREFERRED EMBODIMENTS

Figure 1:
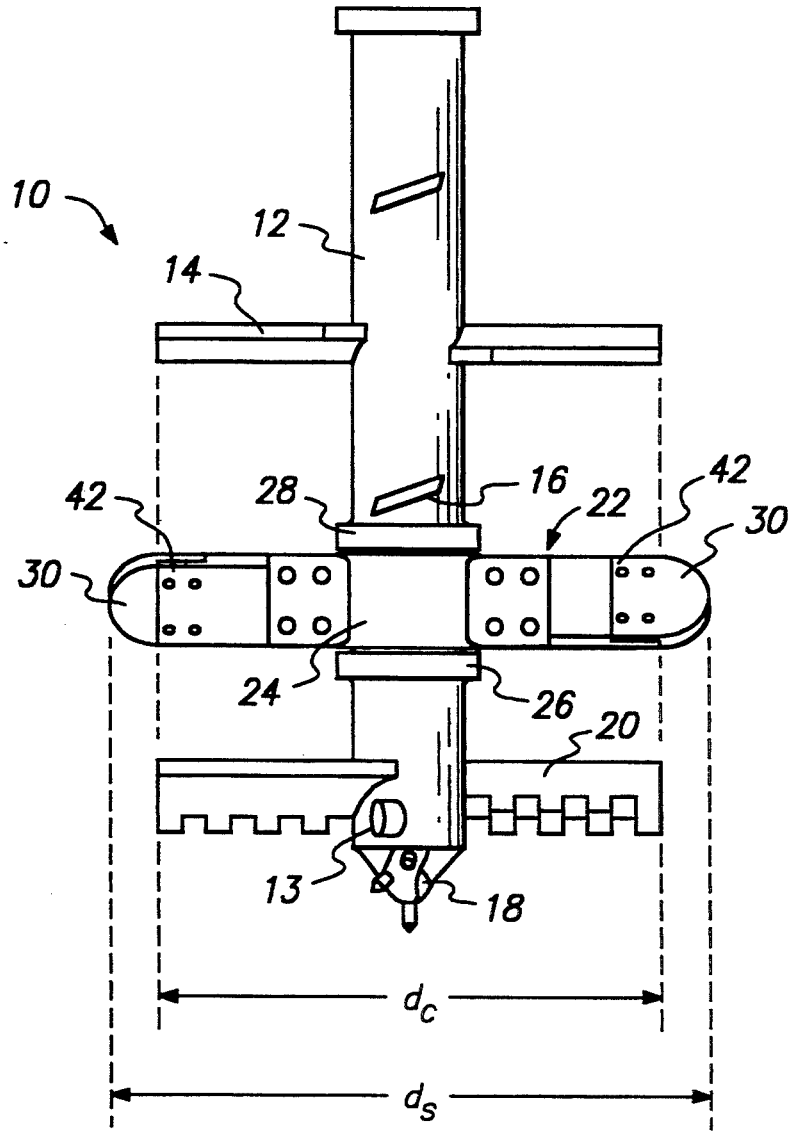
FIG. 1 is a front perspective view of a preferred embodiment of the drilling apparatus of the present invention.

An inventive drilling apparatus 10 according to the present invention is shown in FIG. 1. The preferred embodiment of the drilling apparatus 10 of the present invention comprises a shaft 12, a plurality of cutting blades 14, 16, an auger bit 18, an excavation blade 20, and a shear blade 22 with an extendible finger 30. The shaft 12 is preferably hollow and provides a port 13 proximate the first end of the shaft 12. The hollow and the port 13 allow cement and other adhesives to be injected through the shaft 12 and mixed with the soil as the apparatus 10 drills down and is withdrawn. The auger bit 18 is mounted on a first end of the shaft 12 such that the auger bit 18 rotates with the shaft 12. Adjacent to the auger bit 18, the excavation blade 20 is fixed to the shaft 12 and rotates with the shaft 12. The excavation blade 20 has a plurality of teeth that extend downward for cutting into the soil and loosening it as the apparatus 10 is forced downward into the soil. A pair of cutting blades 14 and 16 are also attached to the shaft 12 at a distance away from the first end of the shaft 12. The cutting blades 14, 16 extend radially outward from the shaft 12 and are preferably positioned perpendicular to each other when viewed from the top or bottom. The cutting blades 14, 16 are used to provide additional agitation and mixing of the soil as the apparatus 10 is moved upward or downward. The cutting blades 14, 16, and the excavation blade 20 preferably have the same length to create a pile of loosened soil with a diameter $d_c$.

The shear blade 22 of the present invention is preferably positioned along the shaft 12 in between the cutting blade 16 and the excavation blade 20. Unlike the other blades 14, 16, and 20, the shear blade 22 is not fixably mounted to rotate with the shaft 12. The base members 42 of the shear blade 22 are attached to the shaft 12 by a housing 24. The housing 24 preferably has a diameter slightly larger than the diameter of the shaft 12. Thus, as the shaft 12 rotates, the shear blade 22 is not forced to rotate at the same rate as the shaft 12. However, the friction between the housing 24 and the shaft 12 applies some rotational force to the shear blade 22 as the shaft 12 rotates. Additional and more substantial rotational force is applied to the shear blade 22 by the soil due to movement of the soil by the cutting blades 14, 16 and the excavation blade 20. The housing 24, and thus the shear blade 22, are held in place along the longitudinal axis of the shaft 12 by a pair of supports 26, 28. The supports 26, 28 are mounted to the shaft 12. There is a support 28 positioned above and a support 26 positioned below the housing 24. The supports 26, 28 move the shear blade 22 up and down with movement of the apparatus 10. The shear blade 22 in the present invention rotates at a much slower rate that the other blades 14, 16, 20. In an exemplary embodiment, the shear blade 22 rotates once per 20 rotations of the cutting blade 14 for hard soil and once per 40 rotations of the cutting blade 14 for soft soil. Thus, the soil is mixed as the other blades 14, 16, 20 rotate in parallel planes with respect to the relatively stationary shear blade 22.

Figure 2:
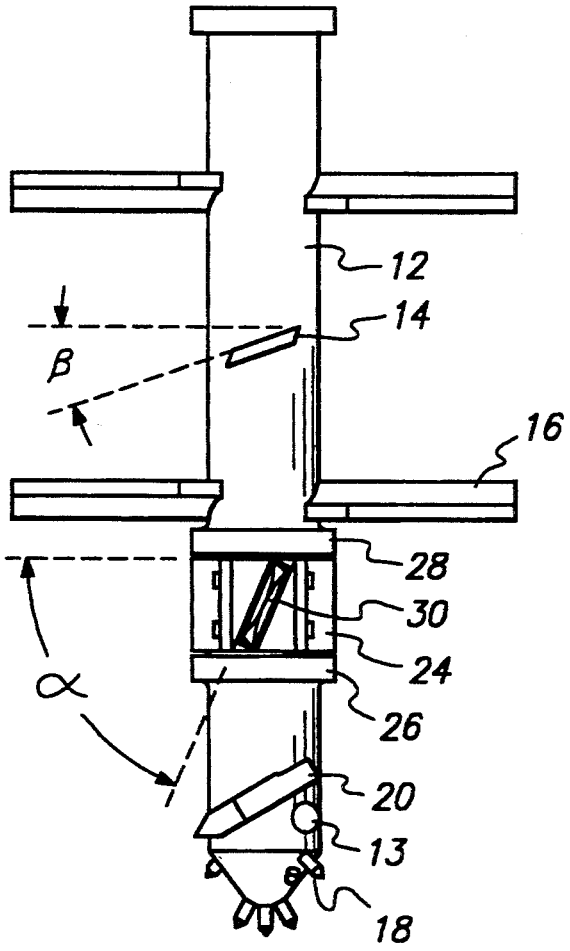
FIG. 2 is a side view of the preferred embodiment of the drilling apparatus of the present invention.

Referring now to FIG. 2, the angle at which the shear blade 22 is attached to the shaft 12 with respect to a horizontal planes is shown. In the preferred embodiment of the present invention, the angle at which the shear blade 22 is attached to the shaft 12 can also be adjusted to control the rotation rate of the shear blade 22. The rotation rate of the shear blade 22 determines the amount of resulting force that will be applied to the shear blade as well as the linear spacing between ribs on the pile constructed with the apparatus 10. In the preferred embodiment, the shear blade 22 is mounted at an angle $\alpha$ from a horizontal plane. In an exemplary embodiment, the angle $\alpha$ is in the range of 70° to 90° for soft soil and in the range of 45° to 75° for hard soil. Similarly, the present invention also allows the angle $\beta$ at which the cutting blades 14, 16 and the excavation blade 20 are attached to the shaft 12 to be modified. In the exemplary embodiment, the angle $\beta$ ranges from 10° to 25° for soft soil, and 5° to 20° for hard soil. Therefore, the adjustments to both the cutting blades 14, 16, 20 and the shear blade 22 will maintain the difference between the rotation rates of the cutting blades 14, 16, 20 and the shear blade 22. Thus, there continues to be a shearing effect to mix the soil even though the shear blade 22 rotates.

Figure 3A:
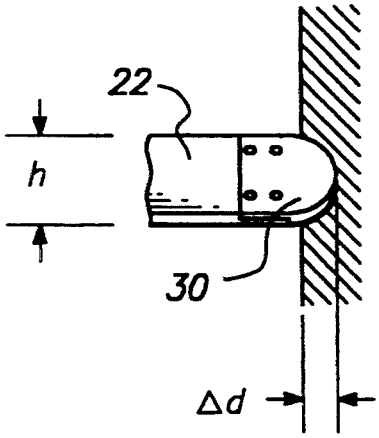
FIGS. 3A and 3B are sectional side views of the shear blade of the present invention with different length fingers attached.
Figure 3B:
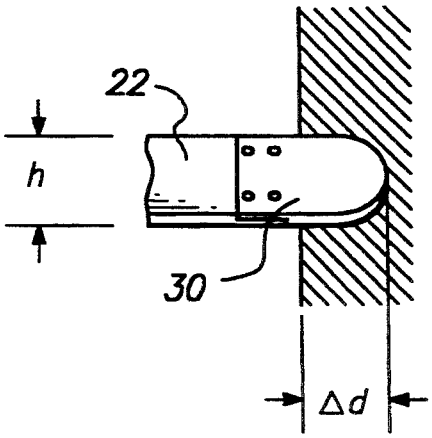

The present invention advantageously provides a shear blade 22 with extendible fingers 30 that rotate to cut through the soil as the apparatus 10 is forced up and down. The shear blade 22 and fingers 30 preferably have a height (h). The pile corresponding to the shear blade 22 and the extendible fingers 30 has a diameter $d_s$. The shear blade 22 and extendible fingers 30 have a combined length equal to diameter $d_s$ that is slightly greater than the diameter $d_c$ of the other blades 14, 16, 20. This difference in diameter ($\Delta d = d_s - d_c$) and the soil conditions determine the amount of resistance to rotation that the shear blade 22 will provide. In the present invention, the diameter $d_s$ of the shear blade 22 is advantageously variable by changing the length of the fingers 30. The fingers 30 preferably vary in length such that $\Delta d$ ranges between zero and 12 inches. Thus, the resistance to rotation provided by the shear blade 22 can be kept constant by changing the length of the fingers 30 attached at distal ends of the shear blade 22 according to the type of soil with which the apparatus is being used. For example, in hard soil, the distance the shear blade 22 extends beyond the diameter $d_c$ is reduced as shown in FIG. 3A because hard soil has a greater resistance to movement. In an exemplary embodiment, the difference ($\Delta d$) between the diameters $d_s$ and $d_c$ is less than two inches. For soft soil, the distance the shear blade 22 extends beyond the diameter $d_c$ is increased as shown in FIG. 3B since soft soil provides less resistance to rotation. In an exemplary embodiment, the difference ($\Delta d$) between the diameters $d_s$ and $d_c$ is between two and six inches for soft soil conditions.

Figure 4A:
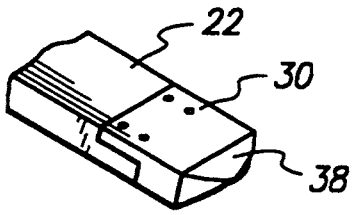
FIGS. 4A–4D show four embodiments for the tips of the finger of the shear blade of the present invention.
Figure 4B:
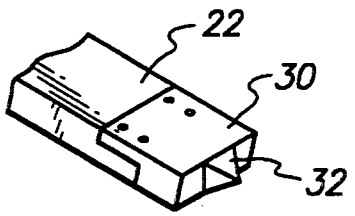
Figure 4C:
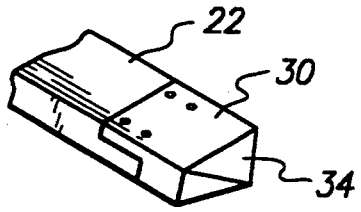
Figure 4D:
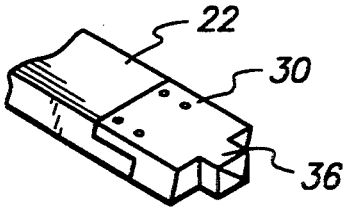

FIGS. 4A–4D show various embodiments for the outer tips 38, 32, 34, 36 on the fingers 30 of the shear blade 22. Each of the figures illustrates a side view and an end view for the tips 38, 32, 34, 36 of the present invention. In the preferred embodiment shown in FIG. 4A, a tip 38 has a disk shape with a single edge on the outermost side and the tip 38 width increasing until it matches the width of the shear blade 22 to which it is attached. FIG. 4B shows a second embodiment for the tip 32 that is particularly useful for hard soil. The tip 32 preferably has a pyramid shape with about half the height of the shear blade 22 at its base, and increasing in width until the tip 32 has the same width as the shear blade 22 at its base. FIG. 4C illustrates another embodiment for a tip 34 similar to the embodiment shown in FIG. 4B. The tip 34 has a similar pyramid shape, but the height of the pyramid at its base equals that of the shear blade 22. Finally, FIG. 4D illustrates a rectangular embodiment for a tip 36. The rectangular tip 36 preferably has the same width as the shear blade and a height about half that of the shear blade 22.

Figure 5A:
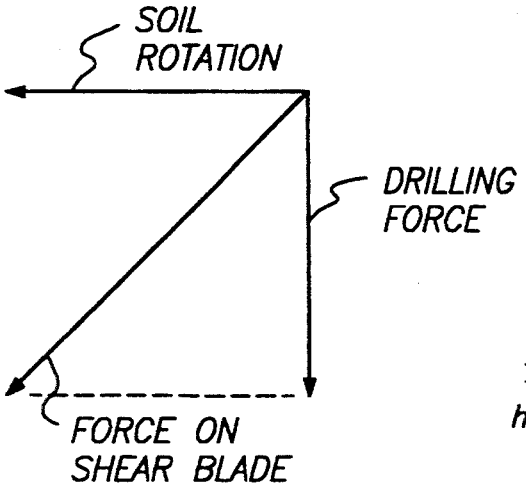
FIG. 5A is diagram of the forces applied to the shear blade and the resulting force.

Referring now to FIG. 5A, one of the advantages of the present invention is more clearly shown. The primary problem in the prior art is that the existing drilling apparatuses are not able to withstand the force that must be applied to drive the shear blade through the unloosened soil. The present invention overcomes this shortcoming of the prior art by allowing the shear blade 22 to rotate, and by applying both a downward drilling force and a rotation force to maximize the resulting force applied to the fingers 30 of shear blade 22 and allow it to cut through soil that has not been loosened. As shown in FIG. 5A, the soil rotation force from friction between the shaft 12 and the housing 24 as well as from the movement of soil against the shear blade 22 due to force applied by the cutting blades 14, 16 combines with the normal drilling force applied to drive the sheer blade 22 through the soil. This combination greatly increases the amount of force available for the shear blade 22 to cut through the soil.

Figure 5B:
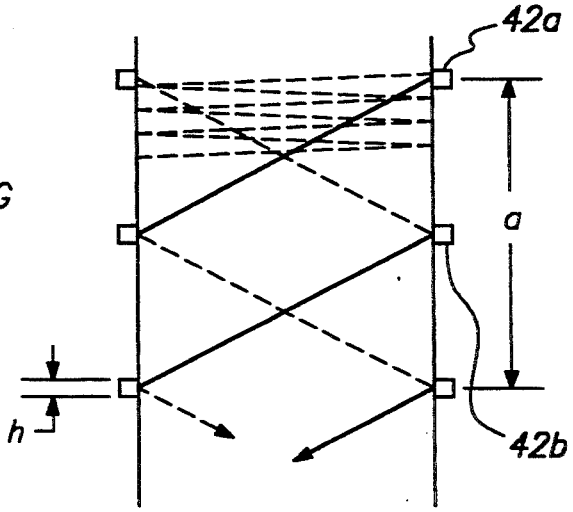
FIG. 5B is a diagram illustrating the number of rotations of the cutting and excavation blades in comparison to the number of rotations of the shear blade according to the present invention.

Another advantage of the present invention is illustrated in FIG. 5B. FIG. 5B is a cross sectional view of the ground remaining in tact after the soil-cement pile has been created using the apparatus 10 of the present invention. As can be seen from FIG. 5B, the rotation rates of the cutting blades 14, 16, and excavation blade 20 differ from the rotation rate of the shear blade 22 by an order of magnitude. In an exemplary embodiment, the shear blade 22 rotates at about 1 RPM while the cutting and excavation blades 14, 16, 20 rotate at about 20–40 RPM. The differential in rotation rates insures that the shear blade 22 will help to shear and mix the soil despite rotation of the shear blade 22. Since the shear blade 22 will rotate about once every minute and the apparatus 10 is able to drill one linear foot per minute, the shear blade 22 of the present invention advantageously creates two ribs per linear foot (one rib is created by each end of the shear blade 22). The vertical distance (a) that the shear blade 22 moves per one rotation is preferably a linear foot but may also be modified by changing the rotation rate and the vertical force applied to the drilling apparatus 10 according to the soil conditions. As has been noted above, the angle $\alpha$ of the shear blade, the length of the finger 30, and the type of tip 32, 34, 36, 38 can be adjusted to the particular soil conditions in which the apparatus 10 is being used to produce the desired number of ribs on the pile.

Figure 5C:
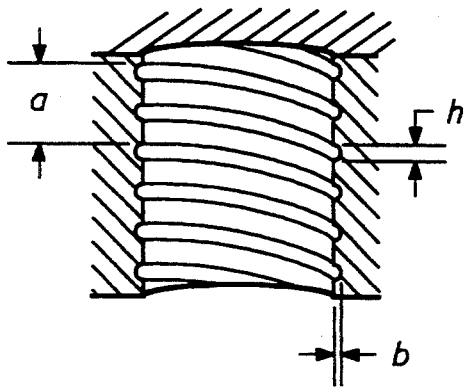
FIG. 5C is a cross sectional side view of the ground remaining undisturbed when using the drilling apparatus of the present invention.

FIG. 5C shows a cross-sectional view of the pile of ground loosened using the mixing apparatus 10 of the present invention. As shown, the shear blade 22 carves a groove/rib in the wall of the pile according to the rate of rotation as the apparatus 10 drills downward. The ribs have a height (h) equal to the height of the shear blade 22. The present invention is particularly advantageous because the spacing between the grooves/ribs can be changed by adjusting the angle of the shear blade 22 as discussed above with reference to FIG. 2. The size of the grooves/ribs on the pile being created can also be adjusted using various length fingers 30 as described above with reference to FIGS. 3A and 3B. As the soil is mixed and injected with cement or other adhesive, a soil pile including these ribs/grooves will be formed. The addition of ribs/grooves to the soil-cement pile is particularly advantageous in several respects. First, the ribs provide the soil pile with added support and stability. The ribs about the periphery of the pile further strengthen the bearing capacity of the pile and hold the pile together. Second, the ribs provide added resistance to vertical movement of the pile. By forming ribs, the surface area and friction of the pile against the existing soil is increased. The bearing capacity of the pile is increased since the ribs increase the circumference and surface area of the pile, and thus, the area over which to distribute the load bearing and uplift on the pile. Third, the interval between ribs and the size of the ribs can be adjusted to the soil conditions with the present invention. By adjusting the angle $\alpha$ of attachment of the shear blade 22, the interval a along the longitudinal axis between ribs can be adjusted. By changing the finger 30 length, and thus, the shear blade length, the distance b that the ribs protrude from the wall of the pile can be adjusted. Thus, for soft soil where the bearing capacity needs to be increased, deep ribs with short intervals can be created using a small angle $\alpha$ and a long finger 30. For hard soil where a shallow rib at long intervals is desired, a large angle $\alpha$ with a short finger 30 can be used. Thus, the present invention is adaptable to a variety of soil conditions.

Figure 6A:
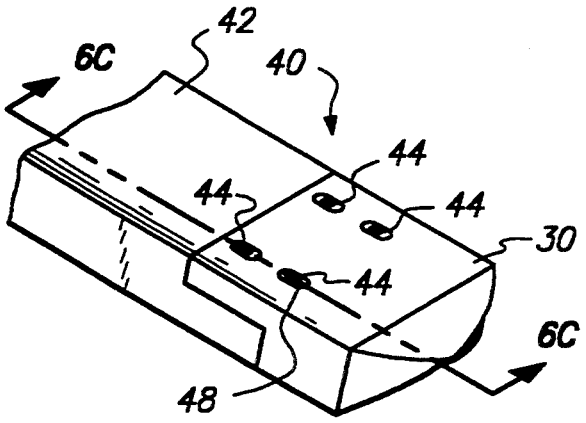
FIG. 6A is a partial perspective side view of the shear blade and extendible finger that provides adjustment of the overall length of the shear blade.
Figure 6B:
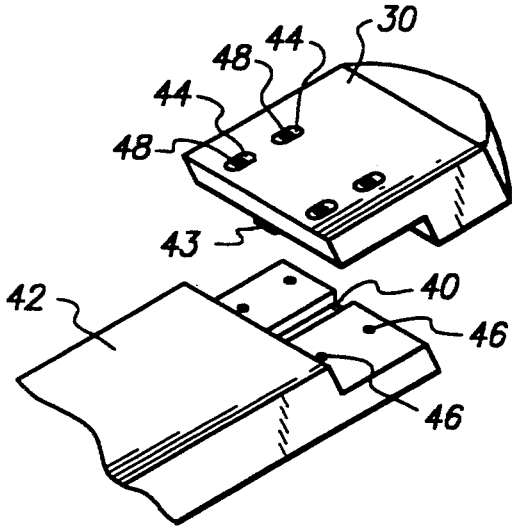
FIG. 6B is an exploded perspective side view of a portion of the shear blade and extendible finger that provides adjustment of the overall length of the shear blade.
Figure 6C:
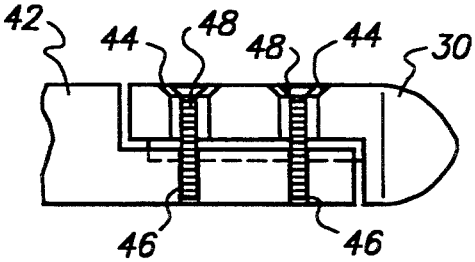
FIG. 6C is a partial cross-sectional side view of the shear blade and extendible finger that provides adjustment of the overall length of the shear blade.

As shown in FIGS. 6A and 6B, the shear blade 22 preferably provides a means to adjust the diameter of the pile of soil loosened by the shear blade 22. In the embodiment shown in FIGS. 6A and 6B, the shear blade 22 comprises a base blade member 42 and a finger 30. The base blade member 42 has a generally rectangular plate shape. The end of the base blade member 42 distal the shaft 12 has a stepped shape with a central groove 40 that extend over the stepped surface along the longitudinal axis of the base blade member 42. The end of the base blade member 42 preferably has a thickness about half of the remaining portion of the base blade member 42. The step on the base blade member 42 accommodates and receives a corresponding stepped portion of the finger 30. All the fingers 30 have the corresponding step portion such that when the finger 30 is mounted to the base blade member 42, the finger 30 extends the generally rectangular shape of the shear blade 22. Along the longitudinal axis of the finger 30, there is a protrusion 43. The protrusion is sized to mate with the groove 40 of the base blade member 42. Near the edges of the finger 30, there are a pairs of slots 44. The slots 44 preferably extend along a line parallel to the longitudinal axis of the base blade member 42 and the finger 30. The slots 44 are used to accommodate screws 48 that attach the finger 30 to the base blade member 42. The are four corresponding holes 46 in the base blade member 42 for receiving and mating with the screw 48 that extend through the finger 30. As shown best in FIG. 6C, each of the holes 46 have threads that mate with threads on the screws 48. In the preferred embodiment, four screws 48 are used to fasten the finger 30 to the base blade member 42. This configuration is advantageous because a variety of fingers 30 of different lengths may be used with the base blade member 42. For example, the present invention provides two primary types: one type for hard soil where the finger 30 has a length such that $\Delta d$ is between 1/80 to 1/40 of diameter (dc) and a second type for soft soil where the finger 30 has a length such that $\Delta d$ is between 1/20 and 1/10 of diameter (dc). Further fine adjustment of the overall length of the base blade member 42 and finger 30 is provided by the slots 46 in the finger 30. In addition to the different length fingers 30, different types of tips 32, 34, 36, 38 appropriate for the soil conditions can be utilized and changed as needed.

Figure 7A:
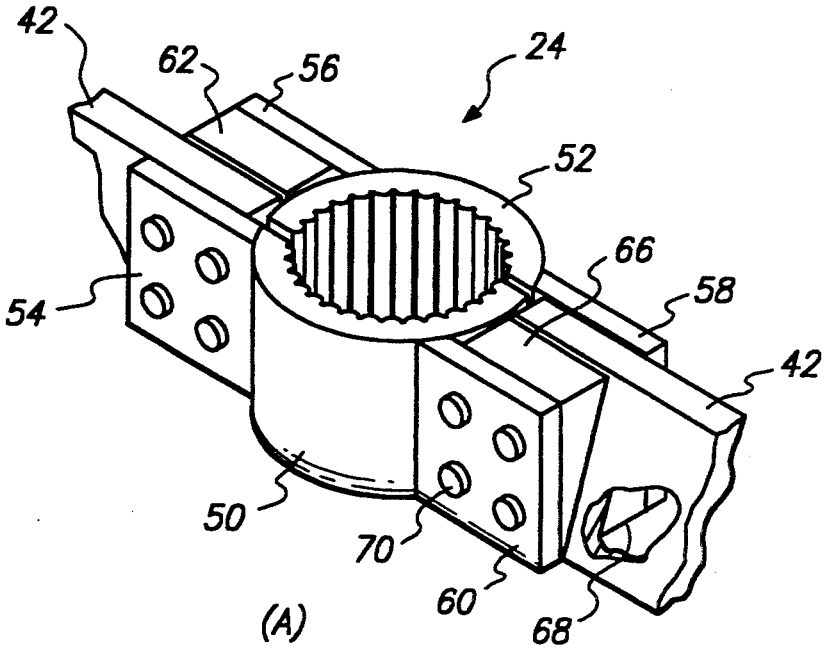
FIG. 7A is a perspective view of the housing and the shear blade that provide adjustment of the angle of the shear blade with respect to a horizontal plane.

Referring now to FIG. 7A, the attachment of the shear blade 22 to the housing 24 is shown in more detail. The present invention advantageously allows the angle $\alpha$ to be adjusted depending the soil conditions in which the apparatus 10 is used. The housing 24 comprises a first and a second cylindrical halves 50, 52, a plurality of flanges 54, 56, 58, 60, and a plurality of taper pins 62, 64, 66, 68. The two cylindrical halves 50, 52 are mounted together as shown in FIG. 7A to provide a close fit about the shaft 12 in between the upper and lower supports 26, 28. The flanges 54, 56, 58, 60 are mounted parallel to the plane of the longitudinal axis of the cylinder. Two flanges 54 and 60, 56 and 58 are mounted to each cylindrical half 50, 52, respectively. Each flange 54, 56, 58, 60 is positioned on an opposite site of the cylinder formed by the halves 50, 52. The flange 54 of the first half 50 is parallel to and mounts with the flange 56 of the second half 52. Similarly, the other flange 60 of the first half is parallel to and mounts to the other flange 58 of the second half 52. Each of the flanges 54, 56, 58, 60 define a plurality of holes. The holes receive bolts 70 that attach the flanges 54 and 56, 58 and 60 together with nuts 72. As shown in FIG. 7A, the inner wall of the cylinder formed by the first and second cylindrical halves 50, 52 has a rough surface with longitudinal ripples. There are preferably corresponding ripples on the exterior surface of shaft 12 over which the halves 50, 52 are mounted. These ripples ensure there will be some translation of rotation force through friction from the shaft 12 to the shear blade 22.

Figure 7B:
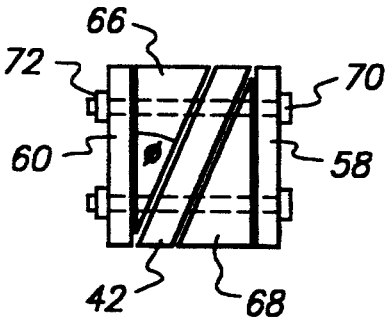
FIGS. 7B and 7C are sectional side views of the housing and the shear blade in two different angled positions with respect to a horizontal plane.
Figure 7C:
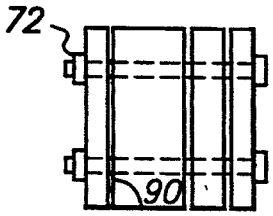
Figure 7D:
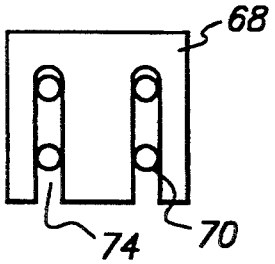
FIG. 7D is a side view of the preferred embodiment for the taper pin of the present invention.

As best shown in FIG. 7B, the taper pins 66, 68 and the base blade member 42 are clamped together between the flanges 58 and 60 when the halves 50, 52 are mounted together. The taper pins 66, 68 and the base blade member 42 similarly have a plurality of holes for receiving the bolts 70 that hold the halves 50, 52 together. The present invention advantageously allows the angle $\alpha$ of the shear blade 22 to be adjusted by using taper pins 66, 68 that position the base blade member 42 at different positions. For example, the amount of taper can be set to be an angle $\phi$. The angle $\phi$ corresponds to the angle $\alpha$. As shown in FIGS. 7C and 7B, the angle of the member 42 may be between 0° (no taper) and 45° (the greatest amount of taper) where the blade members 42 extends from one corner of the flange 58 to the opposite corner of flange 60. As shown in FIG. 7D, the taper pins 62, 64, 66, 68 preferably define slots 74 for receiving the bolts 70. These slots 74 allow the pins 62, 64, 66, 68 to be easily interchanged to adjust the angle of the blade 22 as needed.

Figure 8A:
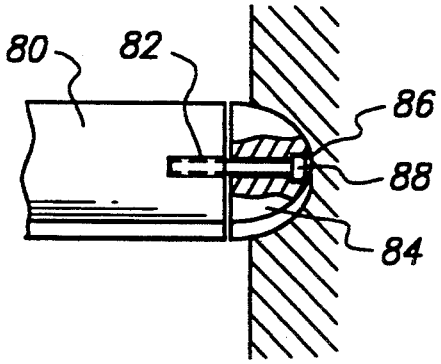
FIGS. 8A and 8B are perspective side views of a second embodiment for the shear blade and extendible finger.
Figure 8B:
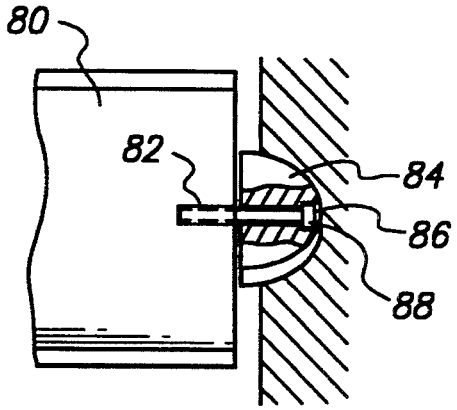
Figure 8C:
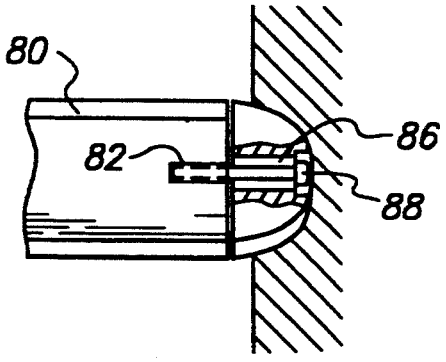
FIG. 8C is a perspective side view of a third embodiment for the shear blade and extendible finger.

Referring now to FIGS. 8A–8D, a second and third embodiment for the fingers 84 and the base blade member 80 of shear blade 22 are shown. In the second embodiment shown in FIGS. 8A and 8B, the base blade member 80 has a generally rectangular shape. A hole 82 is defined along the longitudinal axis of the base blade member 80 beginning from the end distal the shaft 12. The base blade member 80 preferably has a length about the same as the cutting blades 14, 16. In the second embodiment, each finger 84 has a semi-disk shape. The thickness of the finger 84 gradually increases from the rounded edge of the disk to a base with the same thickness as the base blade member 80. The finger 84 preferably defines a cavity 86 for receiving a bolt 88. The bolt 88 is used to mount the finger 84 to the base blade member 80. One end of the bolt 88 is threaded to mate with threads defined in the hole 82 of the base blade member 80. The other end extends into the cavity 86 and has a head that holds the bolt 88 and the finger 84 together while allowing the finger 84 to rotate about the longitudinal axis of the bolt 88. This configuration is particularly advantageous because it eliminates any undue stress on the shear blade 22. The rotatability of the finger 84 permits the finger 84 to find the path (i.e. angle) of least resistance as the apparatus 10 drills down into the ground. As shown in FIG. 8B, the finger 84 preferably has the same size despite changes in the size of the base blade member 80A. In the third embodiment, the cavity 86 is modified to have a slotted shape as shown in FIG. 8C. This modification allows the finger 84 to move vertically according to whether the apparatus 10 is drilling downward or being withdrawn.

Figure 8D:
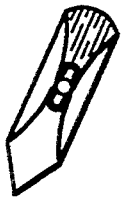
FIG. 8D is an end view of a extendible finger of the second and third embodiments.

The movement of the finger 84 vertically provides further flexibility for applying the appropriate amount of force on the shear blade 22 and finger 84. A modification to the second and third embodiments is shown in FIG. 8D. As shown, the finger 84 may be modified in shape. While retaining its semi-disk shape, the second modification eliminates the symmetry of the finger 84. As shown in FIG. 8D, the second modification to the finger 84 provides a sharp semi-circular cutting edge on the downward side while having a dull, rounded, semi-circular edge on the top side. This is particularly advantageous because the sharp edge is beneficial and need when drilling into the soil and creating ribs. However, when the apparatus 10 is withdrawn, it is advantageous for the finger 84 to follow the rib that was created during the downward drilling process. With the modification, the finger 84 remains in the existing ribs as the apparatus 10 is removed from the ground.

Having described the present invention with reference to specific embodiments, the above description is intended to illustrate the operation of the preferred embodiments and is not meant to limit the scope of the invention. For example, the angle and diameter of the shear blade may also be adjusted by welding the various length shear blades at the desired angles. The scope of the invention is to be limited only by the following claims. From the above discussion, many variations will be apparent to one skilled in the art that would yet be encompassed by the true spirit and scope of the present invention.

What is claimed is:

1. A drilling apparatus for producing a pile with ribs, the drilling apparatus comprising:

a hollow shaft having a first and second ends, and a port proximate the first end;

an auger bit attached at the first end of the shaft to rotate with the shaft;

an excavation blade attached to rotate with the shaft, the excavation blade attached proximate the auger bit;

a cutting blade attached to rotate with the shaft; and a shear blade having a first end and a second end, the shear blade mounted about the shaft at a fixed longitudinal position such that the shear blade can rotate about a longitudinal axis of the shaft independent of rotation of the shaft, the first and second ends of the shear blade adapted for mounting a finger, the length of the shear blade and finger being variable between a length equal to the excavation blade and lengths greater than the excavation blade; and a plurality of pairs of fingers, each pair of fingers having a different length.

2. The drilling apparatus of claim 1, wherein the shear blade is mounted to the shaft at a position in between the excavation blade and cutting blade.

3. The drilling apparatus of claim 1, wherein the fingers increase the diameter of the column of soil loosened by the shear blade by zero to 1/10 of the diameter.

4. The drilling apparatus of claim 1, wherein the fingers have a length such that the shear blade rotates at a rate an order of magnitude slower than the rotation rate of the cutting and excavation blades.

5. The drilling apparatus of claim 1, wherein the plurality of fingers each have a generally rectangular shape with one end being semi-circular.

6. The drilling apparatus of claim 1, wherein the first and second ends of the shear blade each have a stepped shape and define a groove for receiving one of the fingers, and wherein each finger has a corresponding stepped shape with a protrusion on the step, the protrusion mating with the groove of the first and second ends.

7. The drilling apparatus of claim 6, wherein the first and second ends each define a plurality of holes, and each finger defines a plurality of slots, and the apparatus includes a plurality of fastening means, each fastening means being inserted through a respective slot and into a respective hole to mount each finger to an end of the shear blade.

8. The drilling apparatus of claim 1, wherein the shear blade further comprises:

a housing having a generally cylindrical shape with an inner diameter slightly greater that the outer diameter of the shaft;

a pair of blade members attached to the housing and extending radially outward in opposite directions, each of the blade members having one of the variable length fingers attached on the end distal the housing;

a first and second supports mounted to the shaft, the first and second supports being circular bands with outer diameters greater than the inner diameter of the housing, the first and second supports mounted along the shaft on opposite sides of the housing to prevent the housing from moving along the longitudinal axis of the shaft.

9. The drilling apparatus of claim 8, wherein the housing further comprises:

a first cylindrical half having ends and an inner side, a first flange and a second flange attached to opposite ends of the first cylindrical half and extending in opposite directions radially outward from the shaft, the inner side of the first cylindrical half having a roughened surface for resistance with rotation of the shaft; and a second cylindrical half having ends and an inner side, a third flange and a fourth flange attached to opposite ends of the second cylindrical half and extending in opposite directions radially outward from the shaft, the inner side of the second cylindrical half having a roughened surface for resistance with rotation of the shaft.

10. The drilling apparatus of claim 8, further comprising means for positioning the blade members such that they lie in planes with different angles with respect to a horizontal plane.

11. The drilling apparatus of claim 10, wherein the means for positioning the blade members are pairs of taper pins, each pair of pins having the same amount of taper, the amount of taper on each pair of pins determining the angle between the plane in which blade member lies and the horizontal plane.

12. The drilling apparatus of claim 10, wherein shear blade further comprises:

a pair of rods for mounting the blade members to the housing, the rods attached to the housing with their longitudinal axes perpendicular to the longitudinal axis of the shaft and the housing; and wherein the blade members and the housing each define a pair of cavities, each cavity sized to receive a respective rod and wherein each blade member includes a locking means for attaching the blade member at a fixed position and angle about the respective rod.

13. The drilling apparatus of claim 10, wherein angle of the plane in which the cutting blade lies is adjustable with respect to a horizontal plane.

14. The drilling apparatus of claim 13, wherein the angle of the plane in which the shear blade lies with respect to a horizontal plane is such that the shear blade rotates at a rate an order of magnitude slower than the rotation rate of the cutting and excavation blades.

15. The drilling apparatus of claim 8, wherein each of the blade members defines a hole into its end and along its longitudinal axis for receiving a mounting means, and wherein each of the fingers defines a cavity for receiving the mounting means, the mounting means coupling the finger on the end of the blade member while allowing the finger to rotate about the longitudinal axis of the blade member.

16. The drilling apparatus of claim 15, wherein the cavity defined by the finger creates a slot which allows both rotation of the finger about the mounting means and movement of the finger vertically with respect to the blade member.

17. The drilling apparatus of claim 8, wherein the finger has a generally semi-circular disk shape with an edge having a first portion and a second portion, the first portion of the edge converging to a point for cutting through the soil and the second portion of the edge being dull and rounded.

18. The drilling apparatus of claim 1, wherein the shear blade has a tip on an end of the finger and the tips have a pyramid shape.

19. The drilling apparatus of claim 1, wherein each finger of the shear blade has a tip and the tips are shaped as a pyramid, the base of the pyramid attached to the ends of the finger, the base of the pyramid being about half the height of the finger and the same thickness as the finger.

20. The drilling apparatus of claim 1, wherein each finger of the shear blade has a tip, the tips having a disk shape converging to a single edge on the outermost radial side and the tip width increasing until it matches the width of the finger to which it is attached.

21. The drilling apparatus of claim 1, wherein each finger of the shear blade has a tip, the tips having a generally rectangular shape with the width of the tip about the same as that of the finger and a height of the tips about half that of the finger.

* * * * *